United States Patent [19]

Furco

[11] Patent Number: 4,517,998

[45] Date of Patent: May 21, 1985

[54] COMB FOR GEOMETRIC HAIR STYLING

[76] Inventor: Samuel J. Furco, 230 Plymouth Dr., Syracuse, N.Y. 13206

[21] Appl. No.: 584,129

[22] Filed: Feb. 27, 1984

[51] Int. Cl.[3] ..... A45D 24/00

[52] U.S. Cl. ..... 132/11 R

[58] Field of Search ..... 132/11 R, 112, 125, 132/137–138, 157; 15/105

[56] References Cited

U.S. PATENT DOCUMENTS

| | | | |
|---|---|---|---|
| 2,507,056 | 5/1950 | Smith | 15/105 |
| 2,605,773 | 8/1952 | Auclair | 132/11 R |
| 4,368,745 | 1/1983 | McGuffey | 132/11 R |

*Primary Examiner*—Gregory E. McNeill

*Attorney, Agent, or Firm*—Bruns and Wall

[57] ABSTRACT

A combination comb and sight gauge that can be manipulated using one hand so that the operator's other hand is free to cut or trim hair. The instrument is ideally suited for creating geometric hair styles.

6 Claims, 5 Drawing Figures

COMB FOR GEOMETRIC HAIR STYLING

BACKGROUND OF THE INVENTION

This invention relates to a combination comb and guide for aiding in the cutting and trimming of hair and, in particular, to a comb suitable for use in creating geometric hair styles.

Geometrics, as the name implies, relates to a popular type of hair styling wherein the hair is cut or trimmed to very precise geometric patterns. As is well-known, accurate cutting or trimming of hair by a hairdresser or the like involves the coordinated use of both a comb and a pair of hand held scissors. The comb is usually used to lift, and/or align tresses of hair preparatory to cutting. A great deal of skill and care must be exercised, even by a professional operator, to insure that the cut will be correctly taken. An inaccuracy in the cut can destroy the appearance of the style. With the recent renewed interest in geometric styles, the skill of the operator becomes even more critical. Even a skilled operator using the instruments presently available to him finds that he must use a good deal of guesswork in gauging and aligning the hair as it is being cut.

Some combs such as those disclosed in U.S. Pat. Nos. 2,622,603 and 2,245,469 are equipped with graduated scales that are imprinted along the backbone of the comb. The graduations are helpful in measuring the length of the hair, or determining the distance of key hair points from prominent facial features or the nape of the neck. The combs disclosed in U.S. Pat. Design Nos. 116,039 and 201,599 are also equipped with scales but further contain protractor devices by which angular measurements can be taken. Although having a certain amount of utility, these protractor devices generally require the use of two hands to operate, and thus are not of much help when trimming or cutting hair. A further U.S. Pat. No. 2,786,477 discloses a device using a bubble level to aid in the cutting of sideburns. The bubble level is mounted in a flat base from which a pair of adjustable arms are hung. The plate is rested upon the head and the arms brought over the sideburns. In operation, the base is leveled and the arms adjusted to the same length to mark the line of cut. Again the device is clumsy and difficult to operate and can only for used in the trimming of side burns.

SUMMARY OF THE INVENTION

It is therefore an object of the present invention to improve combs, and particularly combs used by professional operators to aid in the cutting and trimming of hair.

A further object of the present invention is to provide an improved comb that is ideally suited for use in creating geometric hair styles.

A still further object of the present invention is to provide a combination comb and gauge that can be easily held in one hand by an operator thus freeing the other hand for use in cutting and trimming.

Another object of the present invention is to provide a comb having one or more sight gauges for aiding in the cutting and trimming of hair.

Yet another object of the invention is to provide a comb having a first sight gauge for enabling an operator to align instrument in a horizontal plane and a second sight gauge for enabling the operator to angularly displace the comb in reference to the horizontal plane.

These and other objects of the present invention are attained by means of a combination comb and gauge having a linear backbone from which a series of teeth depend to position the tips thereof in a common plane that is parallel with the top edge of the backbone. An elongated bubble chamber is mounted in the backbone so that it can be viewed from both sides of the comb as well as along the top edge. The chamber is arranged so that the bubble is centered when the top edge of the backbone lies in a horizontal plane. A further level may be added to the comb which is angularly offset in regard to the horizontal plane to give an indication when the comb lies in a second plane.

BRIEF DESCRIPTION OF THE DRAWINGS

For a better understanding of these and other objects of the present invention reference is had to the following detailed description of the invention which is to be read in conjunction with the accompanying drawing, wherein.

DESCRIPTION OF THE INVENTION

Figures 1, 2, 3, 4, 5:
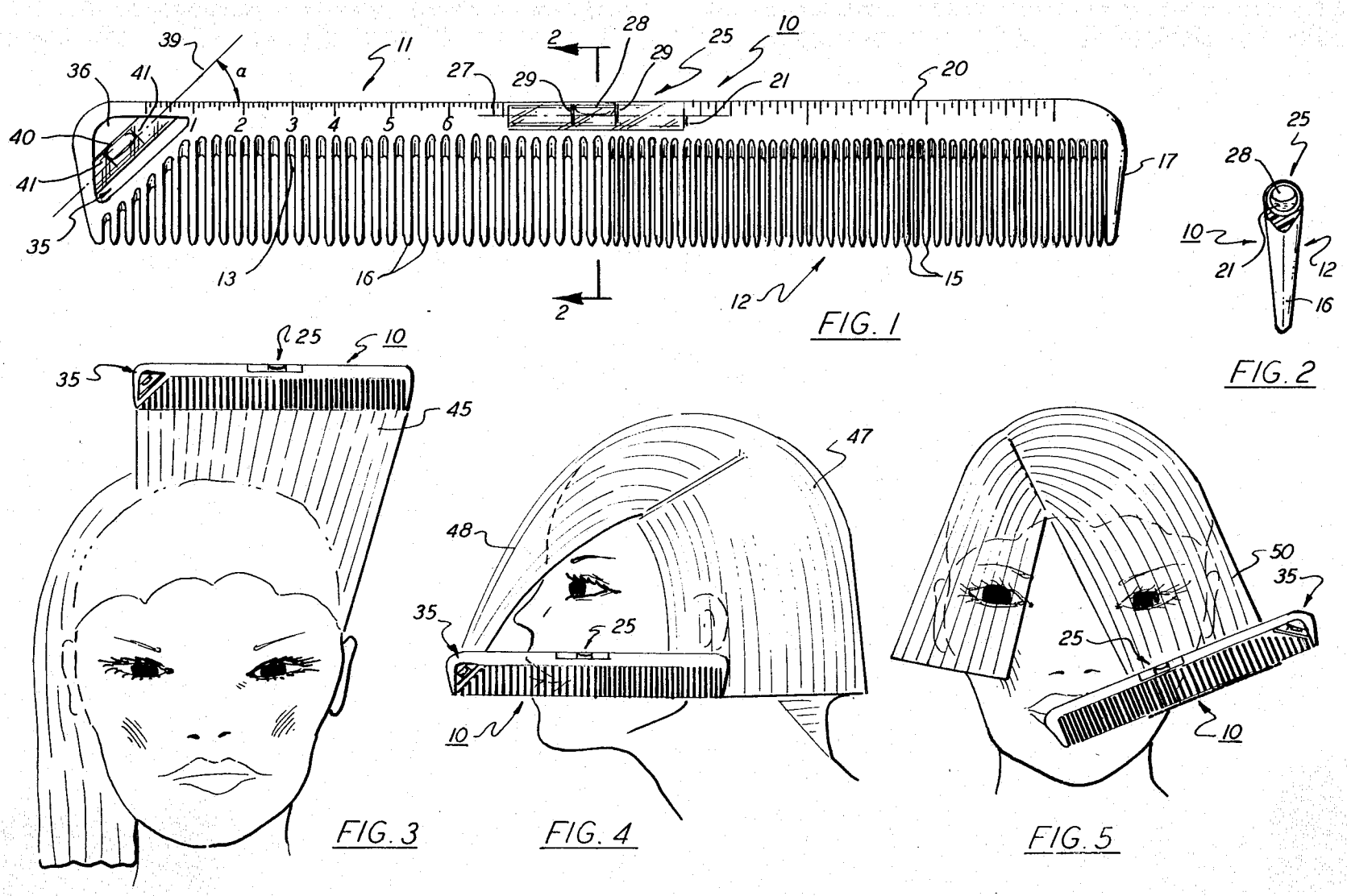
FIG. 1 is a side elevation of a comb embodying the teachings of the present invention.
FIG. 2 is a section taken along lines 2—2 in FIG. 1 showing the position of the horizontally aligned bubble chamber.
FIG. 3–5 are views showing the present comb being used in various ways in the creation of different hair styles.

Turning initially to FIGS. 1 and 2 there is shown therein a comb generally referenced 10 which embodies the teachings of the present invention. The comb is a "professional" comb of the type used by barbers, hairstylists, beauty operators and the like in cutting and trimming hair. The comb is typically about seven inches long and is moved through tresses of hair to align the fibers so that a desired cut can be taken. The comb also, provides a guide along which the operator can direct his scissors as the cut is being taken. The comb can be used to align the ends of the hair fiber so that a straight line cut can be accomplished or it can be angled into the body of the tresses to blend or shingle the hair. In any event, it is important that the operator be able to manipulate his comb with one hand and his scissors with the other hand. As noted above, using instruments presently available to him or her the operator still must display a great deal of skill in order to create some of the popular hair styles and, in particular, those associated with geometrics.

The present comb includes a linear backbone 11 having a series of straight teeth 12 which depend from the bottom edge 13 of the backbone. The teeth, as is conventional, are divided into two sets; a first set containing fine teeth 15—15 and a second set containing coarser teeth 16—16. Located at either end of the comb are also a pair of end teeth 17—17. The end teeth are arranged to blend into the backbone and form an integral part of the comb's super-structure to add strength thereto. The comb is formed of any suitable material as known and used in the art such as injection molded plastics or the like.

The top edge 20 of the backbone is substantially straight and parallels the plane described by the tips of the teeth. The top edge of the backbone is generally semi-circular in form and has a circular recess 21 formed therein which passes downwardly into the backbone. The recess is centered about the midlength point of the comb and contains a cylindrical bubble chamber generally referenced 25 mounted therein. The cylinder, in assembly, is sealed and joined to the backbone by any suitable means that will prevent the cylinder from being dislodged under normal operating conditions. The bubble chamber is filled with any suitable liquid to a level where an air bubble 26 is formed in the chamber. The central axis 27 of the chamber is parallel with the top edge of the backbone whereupon the bubble is brought between a pair of indicator lines 29—29 when the top edge and/or tips of teeth are placed in a horizontal plane. As can be seen, the sight level gives the operator clear indication as to the positioning of the comb and, because of its location, the bubble can be clearly seen and read from almost any direction.

A graduated scale 30 is inscribed or embossed along at least one side of the backbone. The scale may be graduated into any desired unit such as inches or centimeters which might be helpful to the operator in determining the length of hair fibers or the location of key points about the head. Preferably scales run along the length of the backbone on both sides thereof so that they are readily readable regardless of the position of the comb.

Shown at the left hand margin of the comb in FIG. 1 is a second inclined bubble level chamber 35. Again the chamber is a cylindrical sealed member that is mounted in a laterally extended hole 36 formed in the superstructure of the comb. As can be seen the teeth in this end region are foreshortened to provide sufficient room for the hole. The bubble chamber is mounted in the hole and is canted so that its central axis 39 forms a desired angle "a" with the top edge of the backbone. Again the sealed chamber is filled with a liquid to create a bubble 40 therein which can be used to determine when the top edge of the backbone has been displaced from the horizontal plane an amount equal to the noted angle. At this time the bubble 40 will be positioned between the lines 41—41. For the sake of clarity, the bubble is shown centered in FIG. 1.

Preferably the second bubble chamber is set at about a 45° angle in regard to the top edge of the backbone. However, a series of indicator lines may be inscribed along the bubble chamber that indicate the angular displacement of the comb when the bubble reaches various locations along the inclined chamber. The line could be color coded in regard to different angles thus extending the useful range of the present instrument.

Turning now to FIG. 3–5 there are shown some practical applications in which the present instrument can be usefully employed. These illustrations are by way of explanation only, and are not meant to be exhaustive. In FIG. 3 the comb is shown being used to lift a tress 45 upwardly from the nape of the neck to extend the hair fibers and straighten them along generally parallel lines. The comb can be brought into a horizontal plane with the hair captured in the teeth and the strands then trimmed along a straight line in the plane of the comb. Releasing the hair allows it to drop down to provide a straight edge along the shoulders. FIG. 4 shows the comb being used to bridge the gap between two side tresses 47 and 48. Here again the bubble level 25 is used to insure that both edges of the hair tresses terminate in a common plane. FIG. 5 shows the instrument being used to trim a side tress 50 to some desired angle using the inclined bubble chamber 35.

While this invention has been described with specific reference to the details as set forth above, it is not intended to be limited to this specific structure and the invention is intended to cover any modifications or changes that may come within the scope of the following claims.

We claim:

1. A combination comb and guide for aiding in the cutting and trimming of hair that includes a generally linear backbone having a series of teeth perpendicularly disposed from the bottom edge of the backbone said teeth being of substantially equal length so that the tips thereof lie in a common plane that is parallel with the top edge of the backbone, an elongated bubble chamber mounted for viewing in the backbone with the axis of the chamber being parallel with the top edge of said backbone whereby the bubble is centered in the chamber when the top edge is situated in a horizontal plane, said bubble chamber being formed of a transparent material and being recessed below the top edge of the backbone within a slotted opening that is passed downwardly through said top edge of the backbone to permit the bubble to be viewed from the top and either side of the comb.

2. The combination of claim 1 wherein the bubble chamber is centered about the midlength of the comb.

3. The combination of claim 1 that further includes a linear scale inscribed along at least one side of the backbone.

4. The combination of claim 1 that further includes a first set of fine teeth and a second set of coarse teeth.

5. The combination of claim 1 that further includes a second bubble chamber formed of a transparent material, said second bubble chamber being angularly disposed between one of the end teeth and the backbone of the comb whereby a bubble contained in second chamber is centered when the top edge of the comb is angularly disposed in regard to the horizontal plane.

6. The combination of claim 5 wherein the second bubble chamber is mounted at an angle of 45° with the top edge of the plane.

* * * * *